US009750088B2

(12) United States Patent
Hofmann et al.

(10) Patent No.: US 9,750,088 B2
(45) Date of Patent: Aug. 29, 2017

(54) OVEN DOOR AND A CHASSIS FOR A MICROWAVE OVEN OR AN APPLIANCE WITH MICROWAVE HEATING FUNCTION

(71) Applicant: Electrolux Home Products Corporation N. V., Brussels (BE)

(72) Inventors: Arnd Hofmann, Rothenburg ob der Tauber (DE); Klaus Schlotterer-Fratoianni, Rothenburg ob der Tauber (DE)

(73) Assignee: Electrolux Home Products Corporation N. V., Brussels (BE)

( * ) Notice: Subject to any disclaimer, the term of this patent is extended or adjusted under 35 U.S.C. 154(b) by 0 days.

(21) Appl. No.: 14/439,564

(22) PCT Filed: Jan. 27, 2014

(86) PCT No.: PCT/EP2014/051480

§ 371 (c)(1),
(2) Date: Apr. 29, 2015

(87) PCT Pub. No.: WO2014/114778

PCT Pub. Date: Jul. 31, 2014

(65) Prior Publication Data

US 2015/0334788 A1 Nov. 19, 2015

(30) Foreign Application Priority Data

Jan. 25, 2013 (EP) ..... 13152702
Jan. 25, 2013 (EP) ..... 13152704
Oct. 23, 2013 (WO) ..... PCT/EP2013/072149

(51) Int. Cl.
*H05B 6/64* (2006.01)
*H05B 6/76* (2006.01)
*F24C 15/02* (2006.01)

(52) U.S. Cl.
CPC ..... *H05B 6/6405* (2013.01); *H05B 6/6414* (2013.01); *H05B 6/6426* (2013.01); *H05B 6/763* (2013.01)

(58) Field of Classification Search
CPC .. H05B 6/6405; H05B 6/6426; H05B 6/6414; H05B 6/763

(Continued)

(56) References Cited

U.S. PATENT DOCUMENTS 3,679,855 A * 7/1972 Binzer ..... H05B 6/6414 126/200
3,731,035 A * 5/1973 Jarvis ..... H05B 6/6414 126/190

(Continued)

FOREIGN PATENT DOCUMENTS

DE 4031893 A1 4/1991
EP 0131324 A2 1/1985
FR 2532145 A1 2/1984

OTHER PUBLICATIONS

International Search Report for PCT/EP2014/051480, dated Mar. 13, 2014, 2 pages.

*Primary Examiner* — Quang Van
(74) *Attorney, Agent, or Firm* — Pearne & Gordon, LLP

(57) ABSTRACT

An oven door for a microwave oven or an appliance with microwave heating function. The door includes a door frame enclosing the door and glass panels inside and/or in front of the frame. The frame includes a wave choke arranged between a support element and a cover element. The cover element is fixed or fixable at the support element and forms an outer portion of an inner side of the oven door. The cover element is made of a high temperature resistant non-metallic material and covers an outer portion of an inner side of an inner glass panel. The inner glass panel is clamped between the cover element and the support element and/or the wave (Continued)

Figure 1:
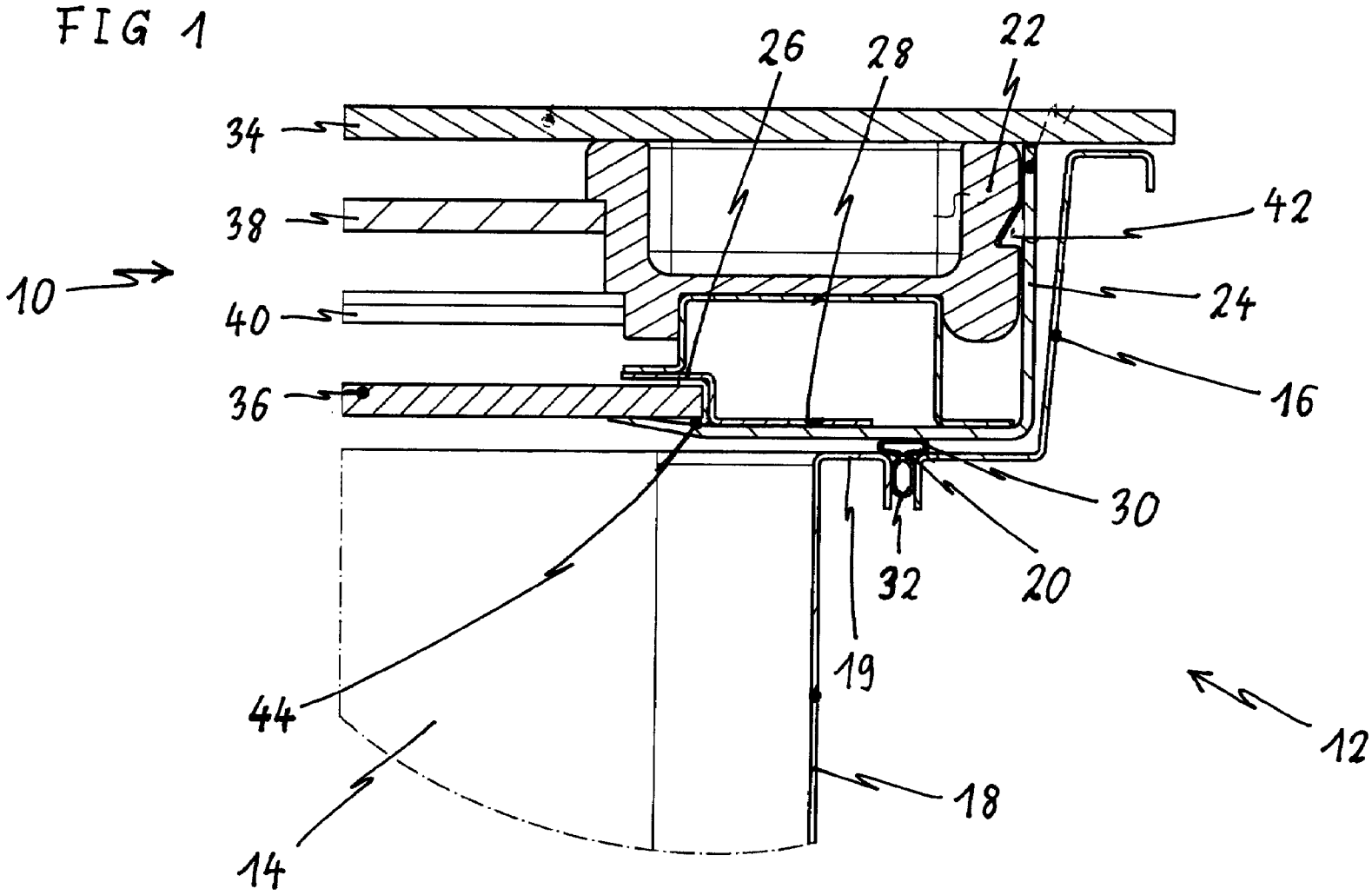

choke. A sealing element made of a high temperature resistant textile material is arranged between the cover element and the inner glass panel. A corresponding chassis is provided for the oven or the appliance.

17 Claims, 3 Drawing Sheets

(58) Field of Classification Search
USPC ..... 219/738–743, 685, 679; 126/198, 190, 126/200; 174/386, 388, 389, 374
See application file for complete search history.

(56) References Cited

U.S. PATENT DOCUMENTS

| | | | | | |
|---|---|---|---|---|---|
| 3,812,316 | A | | 5/1974 | Milburn | |
| 4,013,861 | A | * | 3/1977 | Westfall | H05B 6/763 219/741 |
| 4,059,742 | A | * | 11/1977 | Baron | H05B 6/763 219/685 |
| 4,966,637 | A | * | 10/1990 | Laborie | B29C 55/30 156/185 |
| 5,973,305 | A | * | 10/1999 | Kim | H05B 6/763 174/369 |

* cited by examiner

OVEN DOOR AND A CHASSIS FOR A MICROWAVE OVEN OR AN APPLIANCE WITH MICROWAVE HEATING FUNCTION

The present invention relates to an oven door for a microwave oven or an appliance with microwave heating function. Further, the present invention relates to a chassis for a microwave oven or an appliance with microwave heating function. Moreover, the present invention relates to a microwave oven or an appliance with microwave heating function.

Pyrolytic cleanings are performed very often in modern domestic and professional oven appliances. During the pyrolytic cleaning the inner space of the oven cavity is heated up to about 500° C. Remains of dirt on the inner surfaces of the oven cavity are burnt at these high temperatures. After the pyrolytic cleaning the remaining organic substances can easily be wept out by a cloth.

A conventional cooking oven with pyrolytic cleaning function, but without microwave heating function, includes a planar oven door, which is easy to clean. Known microwave ovens with pyrolytic cleaning function have a wave choke penetrating into the oven cavity. Said wave choke is an open construction, which is difficult to clean. Further, the wave choke does not have an aesthetic appeal. Experiences have shown that oven doors are usually cleaned even more than the rest of the oven cavity in order to maintain its transparency. Moreover, the components of conventional microwave oven doors are glued and mostly have limited heat resistances, so that the pyrolytic cleaning cannot be applied to such microwave oven doors.

Another aspect is the energy consumption of the microwave oven or the other appliances with microwave heating function. The increasing energy costs require microwave ovens and other appliances with low energy consumption. In particular, appliances with microwave heating function and additional conventional heating functions should have minimal thermal losses.

A further aspect is the shielding of the microwaves. The strong electromagnetic fields of the microwave radiation are a potential threat to the health of the operator.

It is an object of the present invention to provide an oven door and a corresponding chassis for a microwave oven or an appliance with microwave heating functions, which allow a pyrolytic cleaning function.

The object of the present invention is achieved by the oven door according to claim 1.

The present invention relates to an oven door a for microwave oven or an appliance with microwave heating function, wherein

- the oven door comprises a door frame enclosing said oven door and a number of glass panels inside and/or in front of said door frame,
- the door frame includes a support element, a cover element and a wave choke,
- the wave choke is arranged between the support element and the cover element,
- the cover element is fixed or fixable at the support element,
- the cover element forms at least an outer portion of an inner side of the oven door,
- the cover element covers an outer portion of an inner side of an inner glass panel,
- the inner glass panel is clamped between the cover element with its inner side and the support element and/or the wave choke with its outer side,

- a sealing element is arranged between the cover element and the inner glass panel,
- the sealing element is made of a high temperature resistant textile material, and
- the cover element is made of a high temperature resistant non-metallic material.

The main idea of the inventive oven door is the structure of the inner side of the oven door on the one hand and the sealing element and cover element made of the high temperature resistant materials on the other hand. The cover element forms the outer portion of the inner side of the oven door, while the inner glass panel forms an inner portion of said inner side of the oven door, so that the inner side of the oven door is formed as a substantially smooth surface. The structure of the inner side of the oven door and the high temperature resistant materials allow the pyrolytic cleaning function. The smooth surface of the inner side of the oven door is easy to clean and more hygienic. The inventive oven door can be easily produced.

Preferably, the textile material of the sealing element and the non-metallic material of the cover element are heat resistant up to more than 500° C., preferably up to more than 550° C.

In particular, the non-metallic material of the cover element includes high temperature resistant textiles and/or ceramics.

For example, the cover element includes an L-shaped profile, wherein an outer portion of said L-shaped profile covers at least a part of a circumferential side of said oven door.

According to a preferred embodiment of the present invention, the cover element is fixed or fixable at the support element by a snap-in mechanism.

The snap-in mechanism may include a snap-in projection and a groove for receiving said snap-in projection, wherein the snap-in projection is arranged at an inner side of the outer portion of the L-shaped profile of the cover element and the groove is arranged at an outer side of the support element.

In a similar way, the snap-in mechanism may include a snap-in projection and a groove for receiving said snap-in projection, wherein the snap-in projection is arranged at an outer side of the support element and the groove is arranged at an inner side of the outer portion of the L-shaped profile of the cover element.

Alternatively, the cover element may be fixed or fixable at the support element by screws.

According to a further embodiment, the cover element may be fixed or fixable at the support element by a press stud fixation.

The object of the present invention is further achieved by the chassis according to claim 10.

The chassis according to the present invention is provided for a microwave oven or an appliance with microwave heating function, wherein

- the chassis comprises an oven cavity and a front frame enclosing circumferentially at least a part of a front opening of said oven cavity,
- a gap is formed between the oven cavity and the front frame,
- an elongated gasket is attached in and in front of the gap formed between the oven cavity and the front frame.

The gasket and the gap between the cavity and the front frame allow a thermal insulation. The gap between the cavity and the front frame reduces mechanical tensions.

Preferably, the gasket is made of a high temperature resistant textile material

In particular, the gasket has a thermal resistance of more than 500° C., preferably of more than 550° C.

At last, the microwave oven or an appliance with microwave heating function including a pyrolytic cleaning function, wherein the microwave oven or the appliance with microwave heating function includes the oven door and chassis mentioned above.

In particular, the microwave oven or the appliance with microwave heating function, respectively, allows the pyrolytic cleaning. Since the gasket is made of at least one textile material or textile composite material, the thermal resistance of the gasket is more than 500° C., preferably of more than 550° C., which temperature may occur during pyrolytic cleanings.

Figure 2:
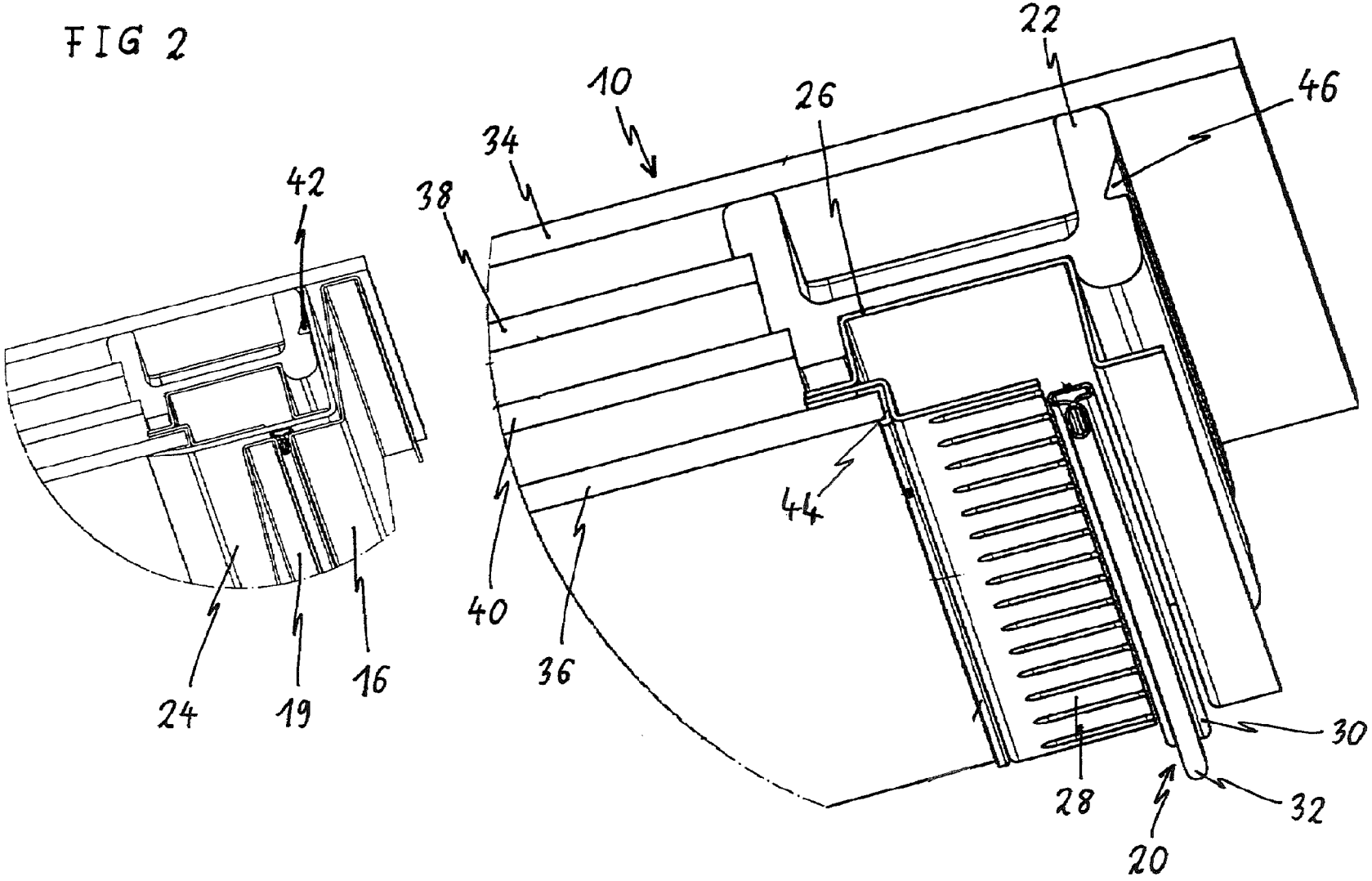
Figure 3:
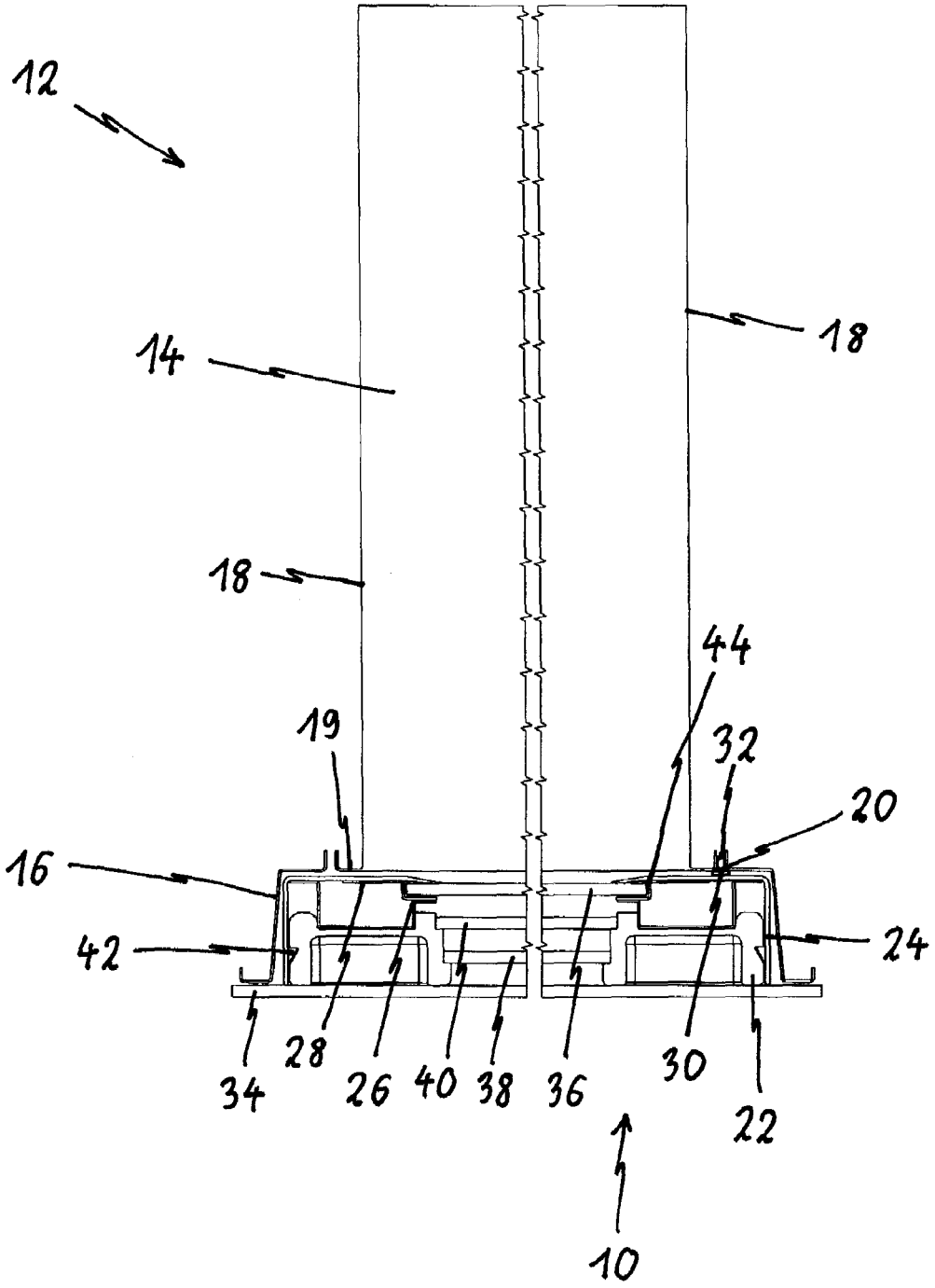

The invention will be explained in more detail below by means of exemplary embodiments. Thereby reference is made to the drawings, wherein FIG. 1 illustrates a schematic partial sectional top view of an oven door and a chassis of a microwave oven according to a preferred embodiment of the present invention, FIG. 2 illustrates a schematic partial sectional perspective view of the oven door and the chassis of the microwave oven according to the preferred embodiment of the present invention, and FIG. 3 illustrates a schematic sectional top view of the oven door and the chassis of the microwave oven according to the preferred embodiment of the present invention.

FIG. 1 illustrates a schematic partial sectional top view of an oven door 10 and a chassis 12 of a microwave oven according to a preferred embodiment of the present invention.

The chassis 12 includes an oven cavity 14 and a front frame 16. The oven cavity 14 is bordered by a side wall 18. A front opening of the oven cavity 14 is enclosed by a flange 19. In this example, the flange 19 is formed as a prolongation of the side wall 18, so that the side wall 18 and the flange 19 are formed as a single-piece part. In this embodiment, the flange 19 and the front portion of the side wall 18 form a U-shaped profile. The front frame 16 encloses the flange 19 of the oven cavity 14. A gap is formed between the front frame 16 and the flange 19.

The oven door 10 comprises a support element 22, a cover element 24 and a wave choke 26. In this example, the wave choke 26 has a G-shaped cross section and includes a lamellae portion 28 comprising a plurality of lamellae. Further, the oven door 10 comprises an outer glass panel 34, an inner glass panel 36, an outer intermediate glass panel 38 and an inner intermediate glass panel 40. The outer intermediate glass panel 38 and inner intermediate glass panel 40 are arranged between the outer glass panel 34 and inner glass panel 36.

The support element 22 forms a front portion of a door frame. In this example, the support element 22 has a substantially U-shaped cross section. The wave choke 26 forms a central portion of the door frame. The cover element 24 forms a rear and outer portion of the door frame. In this example, the cover element 24 is an L-shaped profile. The door frame encloses at least partially the oven door 10.

The cover element 24 is made of a high temperature resistant material. Preferably, the material of the cover element 24 has a heat resistance of more than 500° C. The cover element 24 is made of a non-metallic material. The cover element 24 has a sufficient stiffness for carrying the inner glass panel 36. The structure of the cover element 24 and the arrangement of the inner glass panel 36 and said cover element 24 allow a planar inner side of the oven door 10. All surfaces of the oven door 10, which are exposed to high temperatures, are made of materials having a heat resistance of more than 500° C. Thus, the oven door 10 is suitable for a pyrolytic cleaning of the oven cavity 14.

In this embodiment, the cover element 24 includes a snap-in projection 42. The snap-in projection 42 is arranged at the inner side of the outer portion of the cover element 24. Accordingly, an outer side of the support element 22 includes a groove 46 for receiving the snap-in projection 42 of the cover element 24. The snap-in projection 42 and the structure of the cover element 24 allow a permanent fixation of the inner glass panel 36 at the cover element 24 without need of separate glue joint.

The support element 22 is attached at an inner side of the outer glass panel 34. In this example, the open ends of the U-shaped cross section of said support element 22 are attached at the inner side of the outer glass panel 34. The wave choke 26 is attached at a rear side of the support element 22. In this example, the wave choke 26 is attached at a central portion of the U-shaped cross section of said support element 22. The cover element 24 forms the rear side and outer side of the door frame. A slot in the G-shaped cross section of the wave choke 26 is covered by a rear portion of the cover element 24. Said slot extends along an outer portion of the inner side of the oven door 10.

A gasket 20 is arranged between the flange 19 and the front frame 16 of the chassis 12. In a closed state of the oven door 10 the gasket 20 is arranged between the flange 19, the front frame 16 and the rear side of the cover element 24 of the oven door 10. In particular, the gasket 20 is arranged behind the slot in the G-shaped cross section of the wave choke 26 in the closed state of the oven door 10.

The gasket 20 is made of one or more materials with low heat conductivity and allows thermal insulation.

According to a preferred embodiment of the present invention, the gasket 20 is made of at least one material or composite material allowing a heat resistance of more than 500° C., preferably of more than 550° C. Thus, the oven cavity 14 of the microwave oven is suitable for pyrolytic cleanings.

A sealing element 44 is arranged between the inner glass panel 36, the cover element 24 and the wave choke 26. The wave choke 26 and the rear portion of the cover element 24 form a carrier of the inner glass panel 36. The sealing element 44 is made of one or more high temperature resistant textile materials or composite materials thereof. For example, said textile material or composite textile materials include glass fibres. The textile material made of glass fibres allows a heat resistance of more than 500° C., preferably of more than 550° C. Thus, the sealing element 44 is suitable for pyrolytic cleanings of the microwave oven. Further, said textile materials or composite materials thereof allow a thermal insulation of the space between the inner glass panel 36, the cover element 24 and the wave choke 26. The cover element 24 and the wave choke 26 form the carrier of the inner glass panel 36. Moreover, the sealing element 44 avoids the deposition of dirt in the gap between the inner glass panel 36, the cover element 24 and the wave choke 26. The stiffness of the cover element 24, the sealing element 44 made of temperature resistant textile material or materials and the snap-in projection 42 of the cover element 24 allow the permanent fixation of the inner glass panel 36 at the cover element without need of separate glue joint. The glue joint would not be suitable for the pyrolytic cleaning of the oven cavity 14.

FIG. 2 illustrates a schematic partial sectional perspective view of the oven door 10 and the chassis 12 of the microwave oven according to the preferred embodiment of the present invention.

In FIG. 2 an enhanced version on the right hand side and a reduced version on the left hand side of the same perspective view are shown. In the reduced version on the left hand side the front frame 16, the flange 19 and the cover element 24 are additionally shown. In contrast, said front frame 16, flange 19 and cover element 24 are not shown in the enhanced version on the right hand side in order to clarify geometric details.

The support element 22 is attached at the outer glass panel 34, wherein the open ends of the U-shaped cross section of said support element 22 are attached at the inner side of the outer glass panel 34. The wave choke 26 is attached at the rear side of the support element 22. The gasket 20 is arranged behind the slot in the G-shaped cross section of the wave choke 26 in the closed state of the oven door 10. The front portion 30 of the gasket 20 covers the slot in the G-shaped cross section of the wave choke 26 in the closed state of the oven door 10.

The support element 22 includes the groove 46 for receiving the snap-in projection 42 of the cover element 24. Thus, the cover element 24 is attached or attachable at the support element 22 by a snap-in mechanism. The groove 46 in the support element 22 is shown in the enhanced version on the right hand side, while the snap-in projection 42 of the cover element 24 is shown in the reduced version on the left hand side of FIG. 2.

The sealing element 44 is arranged between the wave choke 26 and the inner glass panel 36.

FIG. 3 illustrates a schematic sectional top view of the oven door 10 and the chassis 12 of the microwave oven according to the preferred embodiment of the present invention.

The outer side of the outer glass panel 34 forms the front of the oven door 10. The rear side of the oven door 10 is formed by the inner glass panel 36 and the rear portion of the cover element 24. The top side, bottom side and lateral sides of the oven door 10 are formed by the side portion of the cover element 24. Thus, the oven door 10 is bordered by smooth surfaces. The outer intermediate glass panel 38 and inner intermediate glass panel 40 are arranged between the outer glass panel 34 and inner glass panel 36.

The chassis 12 includes the oven cavity 14 and the front frame 16. The oven cavity 14 is bordered by the side wall 18. The front opening of the oven cavity 14 is enclosed by the flange 19. The front frame 16 encloses the flange 19 of the oven cavity 14.

The gap formed between the front frame 16 and the flange 19 encloses the oven cavity 14 and allows a thermal insulation between the oven cavity 14 and the front frame 16. There is no heat transfer from the oven cavity 10 to the front frame 20. The gap is filled by the gasket 20. In particular, the gap is filled by the rear portion 32 of the gasket 20. The gasket 20 is made of the thermal insulating material. The gasket 20 allows a sealing between the oven cavity 14 and the front frame 16 on the one hand and prevents the heat transfer from the oven cavity 14 to the front frame 16 on the other hand.

The support element 22 forms the front portion of the door frame, while the wave choke 26 forms the central portion of the door frame. The cover element 24 forms the rear and outer side of the door frame. The door frame encloses at least partially the oven door 10. The support element 22 is attached at an inner side of the outer glass panel 34, wherein the open ends of the U-shaped cross section of said support element 22 are attached at the inner side of the outer glass panel 34. The wave choke 26 is attached at the rear side of the support element 22. The slot in the G-shaped cross section of the wave choke 26 is covered by the rear portion of the cover element 24. The slot extends along the outer portion of the inner side of the oven door 10.

The gasket 20 is arranged between the flange 19 and the front frame 16 of the chassis 12. In the closed state of the oven door 10 the gasket 20 is arranged between the flange 19, the front frame 16 and the rear portion of the cover element 24 of the oven door 10. Further, the gasket 20 is arranged behind the slot in the G-shaped cross section of the wave choke 26 in the closed state of the oven door 10.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 chassis
14 oven cavity
16 front frame
18 side wall
20 gasket
22 support element
24 cover element
26 wave choke
28 lamellae portion
30 front portion of the gasket
32 rear portion of the gasket
34 outer glass panel
36 inner glass panel
38 outer intermediate glass panel
40 inner intermediate glass panel
42 snap-in projection
44 sealing element
46 groove

The invention claimed is:

1. An oven door (10) for a microwave oven or an appliance with microwave heating function, wherein the oven door (10) comprises a door frame (22, 24, 26) enclosing said oven door (10) and a number of glass panels (34, 36, 38, 40) being at least one of inside and in front of said door frame (22, 24, 26), the door frame includes a support element (22), a cover element (24) and a wave choke (26), said support element (22) forming a front portion of the door frame (22, 24, 26), the wave choke (26) is arranged between the support element (22) and the cover element (24), the cover element (24) is fixed or fixable at the support element (22), the cover element (24) forms at least an outer portion of an inner side of the oven door (10), the cover element (24) covers an outer portion of an inner side of an inner glass panel (36), the inner glass panel (36) is clamped between the cover element (24) with its inner side and at least one of the support element (22) and the wave choke (26) with its outer side, a sealing element (44) is arranged between the cover element (24) and the inner glass panel (36), the sealing element (44) is made of a high temperature resistant textile material, and the cover element (24) is made of a high temperature resistant non-metallic material, wherein the cover element (24) includes an L-shaped profile and an outer portion of said L-shaped profile covers at least a part of a circumferential side of said oven door (10).

2. The oven door according to claim 1, wherein both the textile material of the sealing element (44) and the non-metallic material of the cover element (24) are heat resistant up to more than 500° C., preferably of more than 550° C.

3. The oven door according to claim 1, wherein the non-metallic material of the cover element (24) includes at least one of high temperature resistant textiles and ceramics.

4. The oven door according to claim 1, wherein the cover element (24) is fixed or fixable at the support element (22) by a snap-in mechanism (42, 46).

5. The oven door according to claim 1, wherein the cover element (24) is fixed or fixable at the support element (22) by a snap-in mechanism (42, 46) that includes a snap-in projection (42) and a groove (46) for receiving said snap-in projection (42), wherein the snap-in projection (42) is arranged at an inner side of the outer portion of the L-shaped profile of the cover element (24) and the groove (46) is arranged at an outer side of the support element (22).

6. The oven door according to claim 1, wherein the cover element (24) is fixed or fixable at the support element (22) by a snap-in mechanism (42, 46) that includes a snap-in projection (42) and a groove (46) for receiving said snap-in projection (42), wherein the snap-in projection (42) is arranged at an outer side of the support element (22) and the groove (46) is arranged at an inner side of the outer portion of the L-shaped profile of the cover element (24).

7. The oven door according to claim 1, wherein the cover element (24) is fixed or fixable at the support element (22) by screws.

8. The oven door according to claim 1, wherein the cover element (24) is fixed or fixable at the support element (22) by a press stud fixation.

9. The oven door according to claim 1, wherein the support element (22) has a U-shaped cross section.

10. The oven door according to claim 9, wherein the wave choke (26) is attached at a central portion of the U-shaped cross section of the support element (22).

11. The oven door according to claim 1, wherein the wave choke (26) has a G-shaped cross section and a lamellae portion (28) comprising a plurality of lamellae.

12. The oven door according to claim 11, wherein the sealing element (44) is arranged behind a slot in the G-shaped cross section of the wave choke (26).

13. A chassis (12) for a microwave oven or an appliance with microwave heating function, wherein the chassis (12) comprises an oven cavity (14) and a front frame (16) enclosing circumferentially at least a part of a front opening of said oven cavity (14), a gap is formed between the oven cavity (14) and the front frame (16), an elongated gasket (20) is attached both within and in front of the gap formed between the oven cavity (14) and the front frame (16), a front portion (30) of the gasket (20) is provided for sealing a gap between the chassis (12) and an oven door (10) arranged or arrangeable in front of said chassis (12) against steam and heat, a rear portion (32) of the gasket (20) is provided for sealing the gap between the cavity (14) and the front frame (16) against steam, heat and microwaves.

14. The chassis according to claim 13, wherein the gasket (20) is made of a high temperature resistant textile material.

15. The chassis according to claim 13, wherein the gasket (20) has a thermal resistance of more than 500° C., preferably of more than 550° C.

16. The chassis according to claim 13, wherein the oven cavity (14) is bordered by a side wall (18) and the front opening of the oven cavity (14) is enclosed by a flange (19) formed as an extension of the side wall (18), wherein the front frame (16) is attached at a front portion of the side wall (18) and wherein the front frame (16) encloses the flange (19).

17. A microwave oven or an appliance with microwave heating function including a pyrolytic cleaning function, said microwave oven or the appliance with microwave heating function comprising an oven door (10) according to claim 1 and a chassis (12) comprising an oven cavity (14) and a front frame (16) enclosing circumferentially at least a part of a front opening of said oven cavity (14), wherein:

a gap is formed between the oven cavity (14) and the front frame (16), an elongated gasket (20) is attached both within and in front of the gap formed between the oven cavity (14) and the front frame (16), a front portion (30) of the gasket (20) is provided for sealing a gap between the chassis (12) and an oven door (10) arranged or arrangeable in front of said chassis (12) against steam and heat, a rear portion (32) of the gasket (20) is provided for sealing the gap between the cavity (14) and the front frame (16) against steam, heat and microwaves.

* * * * *